US009059550B2

(12) United States Patent
Beak et al.

(10) Patent No.: US 9,059,550 B2
(45) Date of Patent: Jun. 16, 2015

(54) CONNECTOR

(75) Inventors: SeungSeok Beak, Tokyo (JP); Koichi Kiryu, Nagano (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 155 days.

(21) Appl. No.: 13/526,867

(22) Filed: Jun. 19, 2012

(65) Prior Publication Data

US 2012/0329307 A1 Dec. 27, 2012

(30) Foreign Application Priority Data

Jun. 24, 2011 (JP) ..... 2011-141144

(51) Int. Cl.

| | |
|---|---|
| ***H01R 13/44*** | (2006.01) |
| ***H01R 24/70*** | (2011.01) |
| ***H01R 13/703*** | (2006.01) |
| *H01R 103/00* | (2006.01) |

(52) U.S. Cl.

CPC ..... *H01R 24/70* (2013.01); *H01R 13/7036* (2013.01); *H01R 2103/00* (2013.01)

(58) Field of Classification Search

CPC ..... H01R 13/4532; H01R 103/00
USPC ..... 439/140, 188, 346; 200/51.09
See application file for complete search history.

(56) References Cited

U.S. PATENT DOCUMENTS

| | | | | |
|---|---|---|---|---|
| 4,148,536 | A | 4/1979 | Petropoulsos et al. | |
| 4,283,102 | A | 8/1981 | Richier | |
| 5,277,602 | A | 1/1994 | Yi | |
| 7,641,489 | B1 * | 1/2010 | Hsu et al. | 439/188 |
| 7,931,484 | B2 * | 4/2011 | Chen | 439/188 |

FOREIGN PATENT DOCUMENTS

| | | | |
|---|---|---|---|
| CN | 85204879 | U | 11/1986 |
| DE | 91 11 135 | U1 | 3/1992 |
| DE | 43 19 034 | C1 | 2/1995 |
| FR | 2 412 181 | A1 | 7/1979 |
| GB | 1 445 055 | A | 8/1976 |
| JP | H02-150683 | U | 12/1990 |
| JP | 05-082208 | | 4/1993 |
| JP | 2003-031301 | | 1/2003 |

OTHER PUBLICATIONS

Office Action dated Nov. 15, 2014 issued with respect to the corresponding Chinese Patent Application No. 201210294848.0.

* cited by examiner

*Primary Examiner* — Phuongchi T Nguyen
(74) *Attorney, Agent, or Firm* — IPUSA, PLLC

(57) ABSTRACT

A connector includes a movable contact part formed of an insulating material, an electrically conductive movable terminal part, and an electrically conductive fixed terminal part. The movable terminal part and the fixed terminal part are caused to come into contact by the movable terminal part being pressed via the movable contact part by an electrically conductive plug electrode terminal of another connector after the plug electrode terminal inserted into a jack terminal opening part of the connector comes into contact with the movable terminal part, so that the plug electrode terminal and the fixed terminal part are electrically connected via the movable terminal part.

16 Claims, 16 Drawing Sheets

CONNECTOR

CROSS-REFERENCE TO RELATED APPLICATION

This application is based upon and claims the benefit of priority of Japanese Patent Application No. 2011-141144, filed on Jun. 24, 2011, the entire contents of which are incorporated herein by reference.

FIELD

A certain aspect of the embodiments discussed herein is related to a connector.

BACKGROUND

Generally, electrical apparatuses operate with electric power supplied from a power supply. In receiving electric power from a power supply, usually, the electric power is supplied from the power supply to an electrical apparatus via a connector. The connector used in this case establishes electrical connection by mating a plug connector and a jack connector as disclosed in Japanese Laid-Open Patent Application No. 5-82208 and Japanese Laid-Open Patent Application No. 2003-31301.

On the other hand, in recent years, studies have been made, as a measure against global warming, of supplying direct-current, high-voltage electric power in power transmission in local areas as well. Such a form of power supply, which is reduced in power loss in voltage conversion or power transmission and does not require an increase in cable thickness, is considered desirable particularly for electrical apparatuses such as servers, which consume a large amount of electric power.

The electric power supplied to electrical apparatuses may affect a human body or operations of electronic components if the voltage of the electric power is high. In the case of using such high-voltage electric power for information apparatuses such as servers, connectors, where electrical connection is established, need to be different from those used for usual alternating-current commercial power supplies because the installation and the maintenance of the apparatuses are manually performed.

SUMMARY

According to an aspect of the present invention, a connector includes a movable contact part formed of an insulating material; an electrically conductive movable terminal part; and an electrically conductive fixed terminal part, wherein the movable terminal part and the fixed terminal part are caused to come into contact by the movable terminal part being pressed via the movable contact part by an electrically conductive plug electrode terminal of another connector after the plug electrode terminal inserted into a jack terminal opening part of the connector comes into contact with the movable terminal part, so that the plug electrode terminal and the fixed terminal part are electrically connected via the movable terminal part.

According to an aspect of the present invention, a connector includes a first connector including an electrically conductive plug electrode terminal, and a housing frame part; and a second connector including a movable contact part formed of an insulating material, an electrically conductive movable terminal part, and an electrically conductive fixed terminal part, wherein the first connector and the second connector are fit and electrically connected to each other by the movable terminal part and the fixed terminal part being caused to come into contact by the movable terminal part being pressed via the movable contact part by the plug electrode terminal after the plug electrode terminal inserted into a jack terminal opening part of the second connector comes into contact with the movable terminal part, so that the plug electrode terminal and the fixed terminal part are electrically connected via the movable terminal part.

The object and advantages of the embodiment will be realized and attained by means of the elements and combinations particularly pointed out in the claims.

It is to be understood that both the foregoing general description and the following detailed description are exemplary and explanatory and not restrictive of the invention.

BRIEF DESCRIPTION OF THE DRAWINGS

Other objects, features and advantages of the present invention will become more apparent from the following detailed description when read in conjunction with the accompanying drawings, in which.

DESCRIPTION OF EMBODIMENTS

Figure 1:
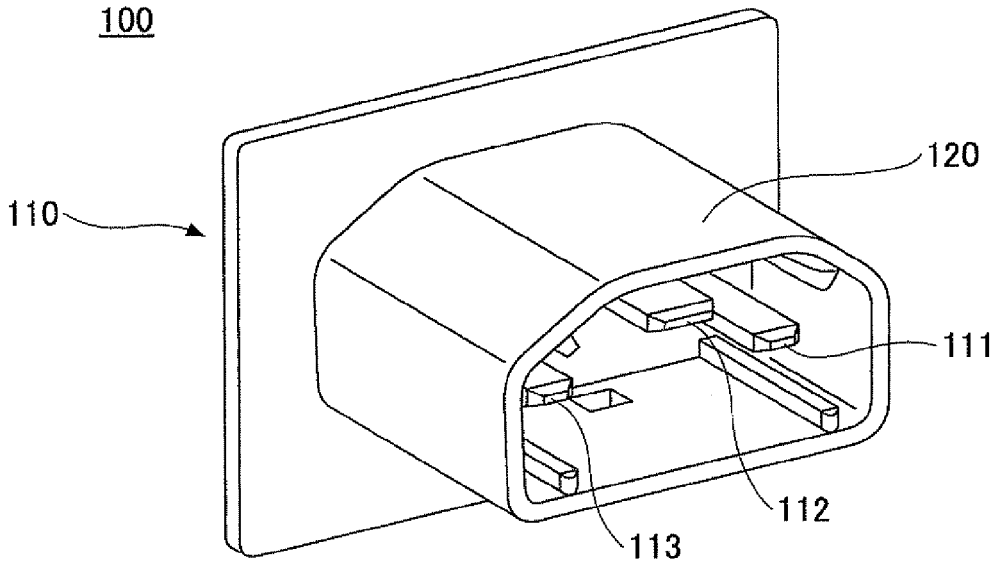
FIG. 1 is a perspective view of a plug connector according to an embodiment.

As described above, in the case of using high-voltage electric power for information apparatuses such as servers, connectors, where electrical connection is established, need to be different from those used for usual alternating-current commercial power supplies.

Therefore, when the electric power supplied from a power supply has a voltage higher than or equal to 100 V or is high-voltage direct-current electric power, for example, direct-current 400 V, it is dangerous to use connectors currently used for alternating-current 100 V as they are because those connectors do not ensure sufficient safety or reliability with such high-voltage electric power.

According to an aspect of the present invention, a connector is provided that is capable of supplying high-voltage electric power in safety.

According to an aspect of the present invention, a connector is provided that supports a power supply higher in voltage than the current commercial power supply or supports a direct-current power supply and is capable of supplying electric power from these power supplies in safety.

A description is given, with reference to the accompanying drawings, of an embodiment of the present invention. In the following, the same elements or members are referred to by the same reference numeral, and a redundant description thereof is omitted.

A description is given of a connector structure according to this embodiment. A connector according to this embodiment is a connector (or a connector unit) that includes a plug connector 100 and a jack connector 200 illustrated in FIG. 1 and FIG. 2, respectively, or is the jack connector 200. The plug connector 100 and the jack connector 200 are connected to establish electrical connection.

Referring to FIG. 1, the plug connector 100 includes a housing 110 formed of an insulator (insulating material) and three plug electrode terminals 111, 112, and 113 formed of an electrically conductive material such as metal. The housing 110 includes a housing frame part 120 provided around the three plug electrode terminals 111, 112, and 113. A power supply cable (not graphically illustrated) is connected to the plug electrode terminals 111, 112, and 113. According to this embodiment, it is assumed that, by way of example, the plug electrode terminal 111 is connected to the positive terminal of the power supply, the plug electrode terminal 112 is connected to the ground GND (at ground potential) of the power supply, and the plug electrode terminal 113 is connected to the negative terminal of the power supply.

Figure 2:
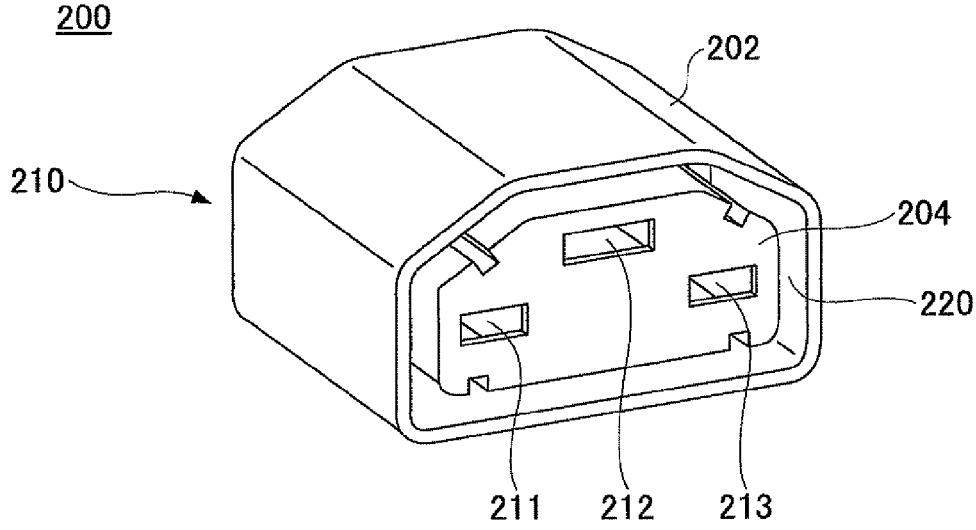
FIG. 2 is a perspective view of a jack connector according to the embodiment.

Referring to FIG. 2, the jack connector 200 includes a housing 210 formed of an insulator (insulating material). The housing 210 includes a housing frame part 202. Further, the jack connector 200 includes an extending part 204 extending from and inside the housing frame part 202. Jack terminal openings (opening parts) 211, 212, and 213 are formed in the extending part 204. The plug electrode terminals 111, 112, and 113 of the plug connector 100 are inserted into the jack terminal openings 211, 212, and 213, respectively, when the plug connector 100 and the jack connector 200 are connected. A connecting frame groove part 220 is formed between the housing frame part 202 and the extending part 204. The housing frame part 120 of the plug connector 100 is inserted into the connecting frame groove part 220 when the plug connector 100 and the jack connector 200 are connected.

Figure 3:
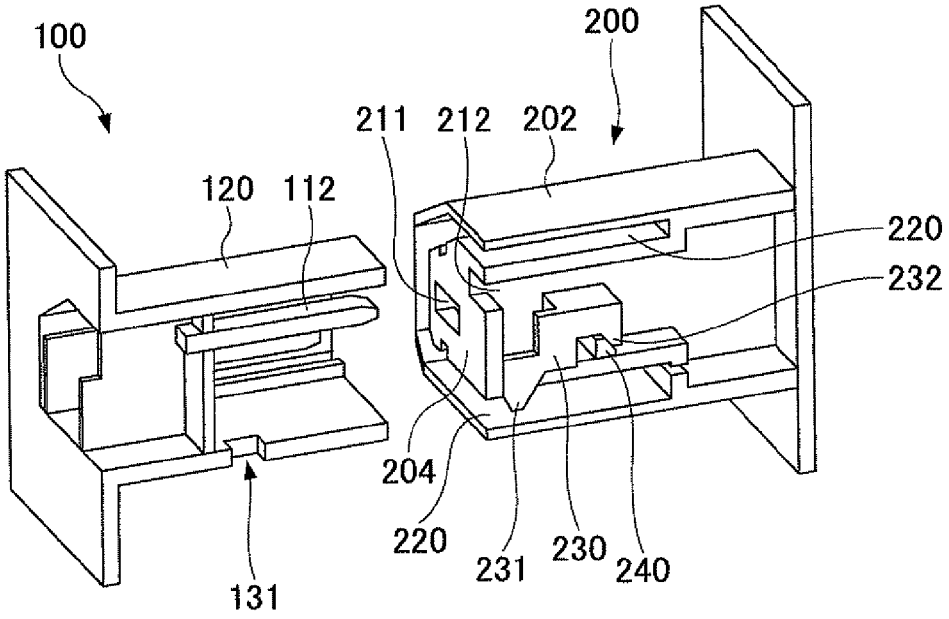
FIG. 3 is a cross-sectional view of the plug connector and the jack connector according to the embodiment.
Figure 4:
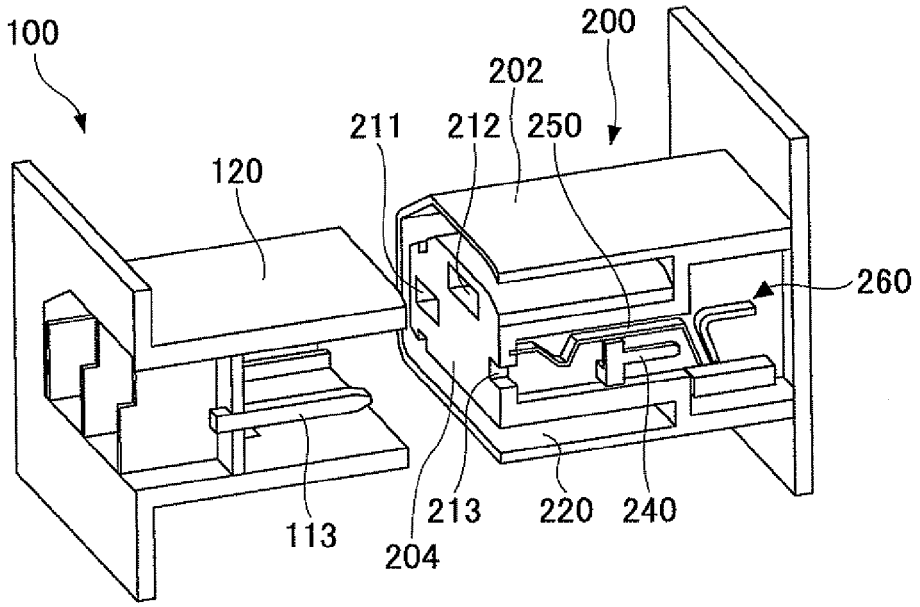
FIG. 4 is another cross-sectional view of the plug connector and the jack connector according to the embodiment.

Next, a description is given in more detail, with reference to FIG. 3 and FIG. 4, of the plug connector 100 and the jack connector 200. FIG. 3 is a cross-sectional view taken along a plane including a lengthwise cross section of the plug electrode terminal 112 and a lengthwise cross section of the jack terminal opening 212. FIG. 4 is a cross-sectional view taken along a plane including a lengthwise cross section of the plug electrode terminal 113 and a lengthwise cross section of the jack terminal opening 213. The jack connector 200 includes jack electrode terminals (not graphically illustrated) that connect to the plug electrode terminals 111, 112, and 113, respectively.

A frame part opening 131 is provided in the housing frame part 120 of the plug connector 100. According to this embodiment, the frame part opening 131 is provided at a position immediately below the plug electrode terminal 112. However, the frame part opening 131 may also be provided at any other positions in the housing frame part 120.

Further, according to this embodiment, the jack connector 200 includes a lock pin 230, a movable contact part 240, movable terminal parts 250, and fixed terminal parts 260, which are provided inside the housing frame part 202.

Figure 5:
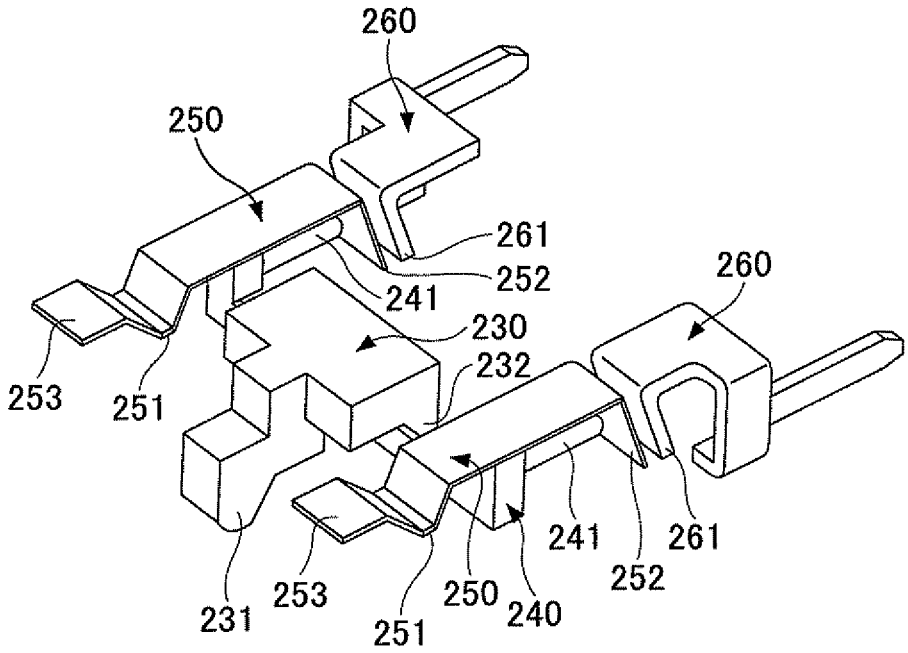
FIG. 5 is a diagram illustrating the interior of the jack connector according to the embodiment.
Figure 6:
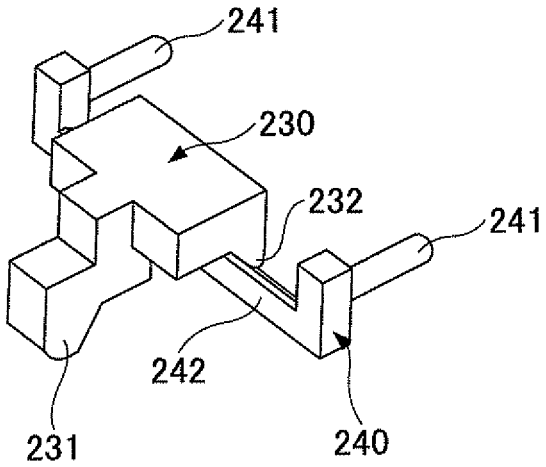
FIG. 6 is a perspective view of a lock pin and a movable contact part according to the embodiment.
Figure 7A:
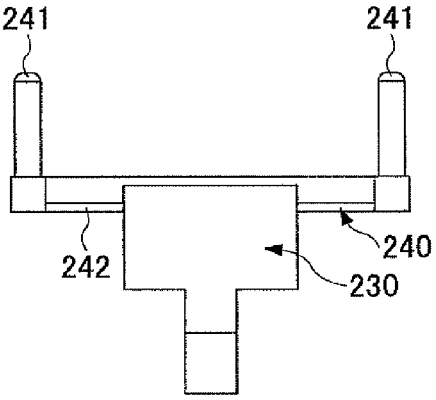
FIGS. 7A through 7E are diagrams illustrating a structure of the lock pin and a structure of the movable contact part according to the embodiment.
Figure 7D:
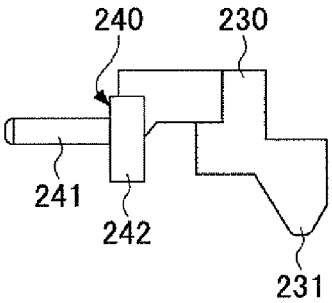
Figure 7B:
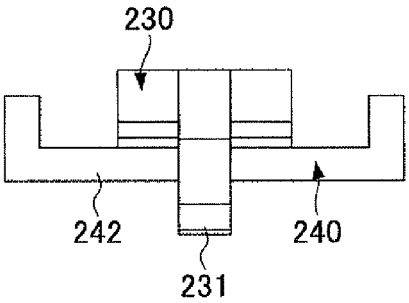
Figure 7E:
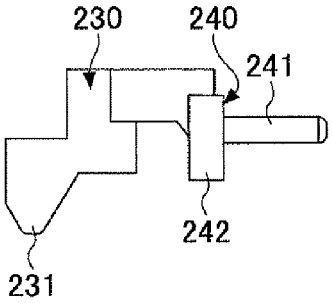
Figure 7C:
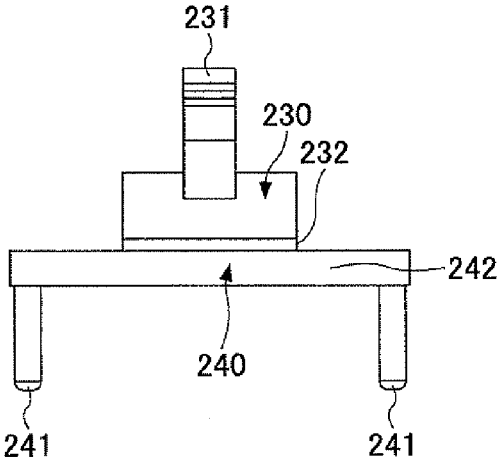
Figure 8:
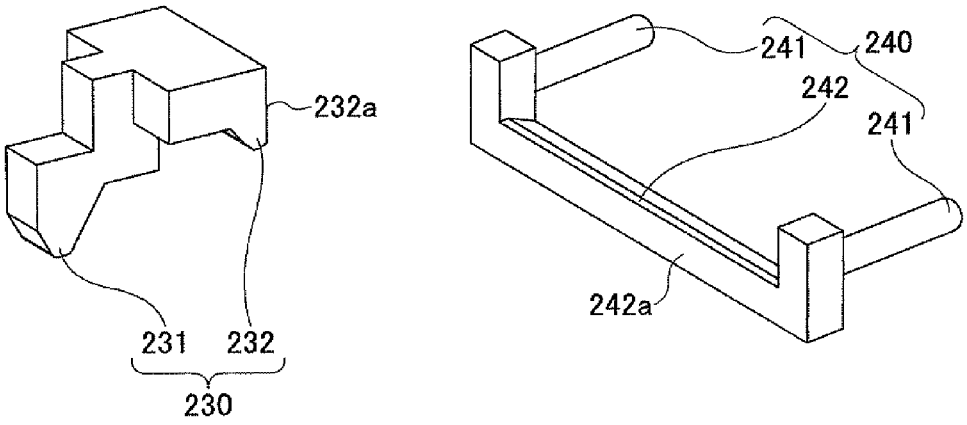
FIG. 8 is a perspective view illustrating the lock pin and the movable part that are separated according to the embodiment.
Figure 9A:
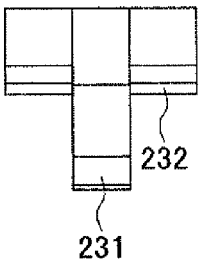
FIGS. 9A through 9C are diagrams illustrating the structure of the lock pin according to the embodiment.
Figure 9C:
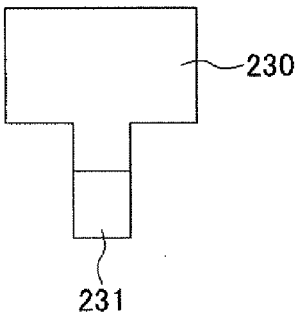
Figure 9B:
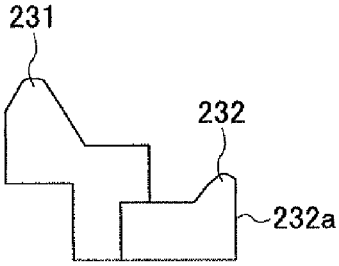
Figure 10A:
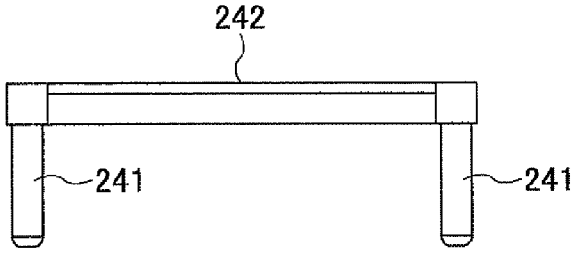
FIGS. 10A through 10C are diagrams illustrating the structure of the movable contact part according to the embodiment.
Figure 10B:
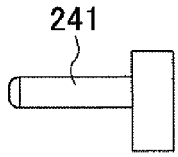
Figure 10C:
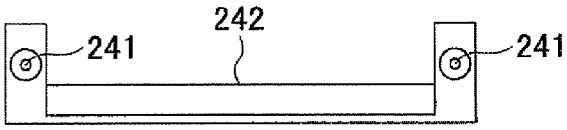

FIG. 5 is a perspective view of the lock pin 230, the movable contact part 240, the movable terminal parts 250, and the fixed terminal parts 260 arranged inside the jack connector 200. FIG. 6 is a perspective view of the lock pin 230 and the movable contact part 240 in a non-limiting arrangement. FIGS. 7A, 7B, 7C, 7D and 7E are a plan view, a front view, a bottom view, a left side view, and a right side view, respectively, of the lock pin 230 and the movable contact part 240 of FIG. 6. FIG. 8 is a perspective view of the lock pin 230 and the movable contact part 240 separated from each other. FIGS. 9A, 9B and 9C are a front view, a side view, and a plan view, respectively, of the lock pin 230. FIGS. 10A, 10B, and 10C are a plan view, a side view, and a rear view, respectively, of the movable contact part 240.

The lock pin 230 includes a projecting part 231. The projecting part 231 projects in the connecting frame groove part 220 (toward the interior surface of the housing frame part 202) with the plug connector 100 and the jack connector 200 being unconnected. When the plug connector 100 and the jack connector 200 are connected, the projecting part 231 is temporarily lifted up by the housing frame part 120 of the plug connector 100 and thereafter enters the frame part opening 131 in the housing frame part 120.

The movable contact part 240 is formed of an insulator. The movable contact part 240 includes two contact pins 241 and a connecting part 242 that connects the two contact pins 241. The two contact pins 241 of the movable contact part 240 are positioned at the back of the jack terminal openings 211 and 213, respectively, inside the extending part 204 so as to be movable (back and forth) in an insertion direction in which the plug electrode terminals 111 and 113 are inserted. Further, in the jack connector 200, the movable terminal parts 250 are provided behind the jack terminal openings 211 and 213, respectively, inside the extending part 204, and the fixed terminal parts 260 are provided further behind the contact pins 241. The contact pins 241 move in the insertion direction to press internal movable terminals 252 of the movable terminal parts 250, so that the movable terminal parts 250 and the fixed terminal parts 260 come into contact with each other.

The lock pin 230 further includes a holding part 232. The projecting part 231 and the holding part 232 define first and second opposite ends, respectively, of the lock pin 230. When the plug connector 100 is not inserted in the jack connector 200, the holding part 232 holds the connecting part 242 of the movable contact part 240, so that the movable contact part 240 is prevented from moving toward the internal movable terminals 252.

The movable terminal parts 250 and the fixed terminal parts 260 are formed of an electrically conductive metal material or the like. With the plug connector 100 and the jack connector 200 being unconnected, the movable terminal parts 250 and the fixed terminal parts 260 are out of contact. Each of the movable terminal parts 250 includes a jack-side terminal 251, the internal movable terminal 252, and an end portion 253. The end portion 253 and the internal movable terminal 252 define first and second opposite ends, respectively, of the movable terminal part 250. The end portion 253 may be fixed to a front wall portion 204*a* of the extending part 204. A portion of the movable terminal part 250 extending from the end portion 253 defines the jack-side terminal 251. The internal movable terminal 252 defines a free end of the movable terminal part 250 and has a spring characteristic. The fixed terminal parts 260 include respective internal fixed terminals 261.

With the plug connector 100 and the jack connector 200 being fit and connected to each other, the plug electrode terminals 111 and 113 are in contact with the jack-side terminals 251 of the corresponding movable terminal parts 250, and the internal movable terminals 252 are in contact with the corresponding internal fixed terminals 261, so that electric power is supplied from the plug connector 100 to the jack connector 200.

Next, a description is given of the connection of the plug connector 100 and the jack connector 200.

Figure 11:
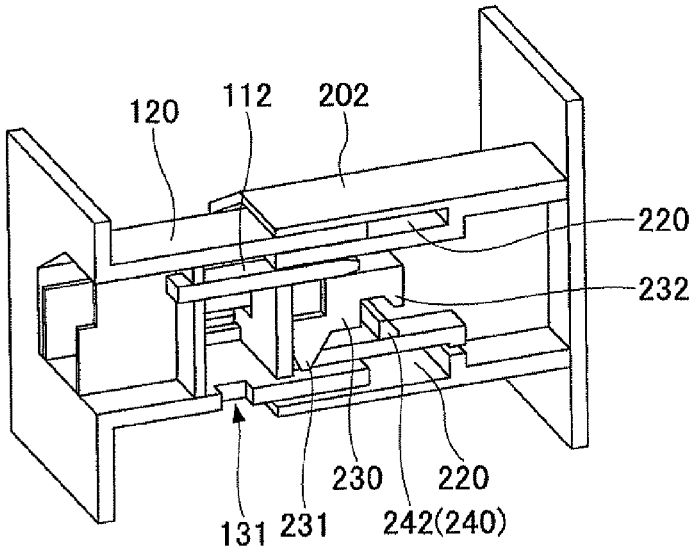
FIG. 11 is a diagram illustrating the connection of a connector according to the embodiment.
Figure 12:
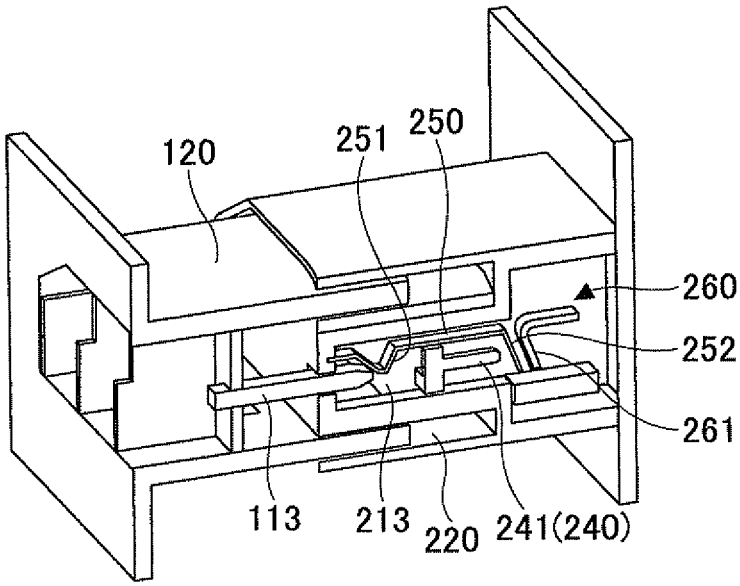
FIG. 12 is another diagram illustrating the connection of the connector according to the embodiment.

First, as illustrated in FIG. 11 and FIG. 12, the plug connector 100 is inserted into the jack connector 200. For example, the plug electrode terminals 111, 112, and 113 of the plug connector 100 are inserted into the jack terminal openings 211, 212, and 213 of the jack connector 200, and the housing frame part 120 of the plug connector 100 is inserted into the connecting frame groove part 220 of the jack connector 200. FIG. 11 is a cross-sectional view taken along a plane including a lengthwise cross section of the plug electrode terminal 112 and a lengthwise cross section of the jack terminal opening 212. FIG. 12 is a cross-sectional view taken along a plane including a lengthwise cross section of the plug electrode terminal 113 and a lengthwise cross section of the jack terminal opening 213.

Figure 13:
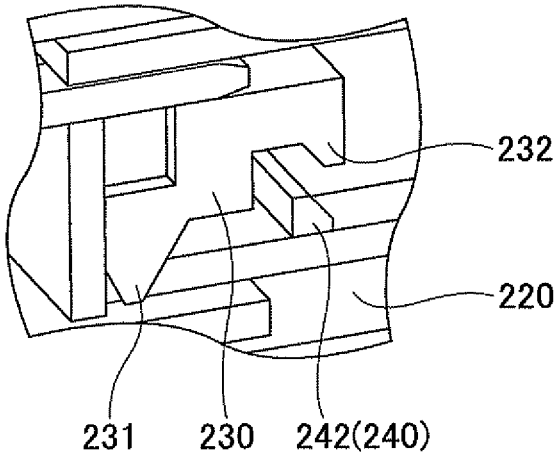
FIG. 13 is an enlarged view of part of the structure illustrated in FIG. 12 according to the embodiment.

FIG. 13 is an enlarged view of part of the structure illustrated in FIG. 12. As illustrated in FIG. 13, by inserting the housing frame part 120 into the connecting frame groove part 220, the projecting part 231 of the lock pin 230, projecting in the connecting frame groove part 220, is pressed (upward) by the housing frame part 120, so that the lock pin 230 moves upward. As a result, the holding part 232 that has held the connecting part 242 of the movable contact part 240 also moves upward. This releases a hold on the connecting part 242 to allow the movable contact part 240 to move.

Figure 14:
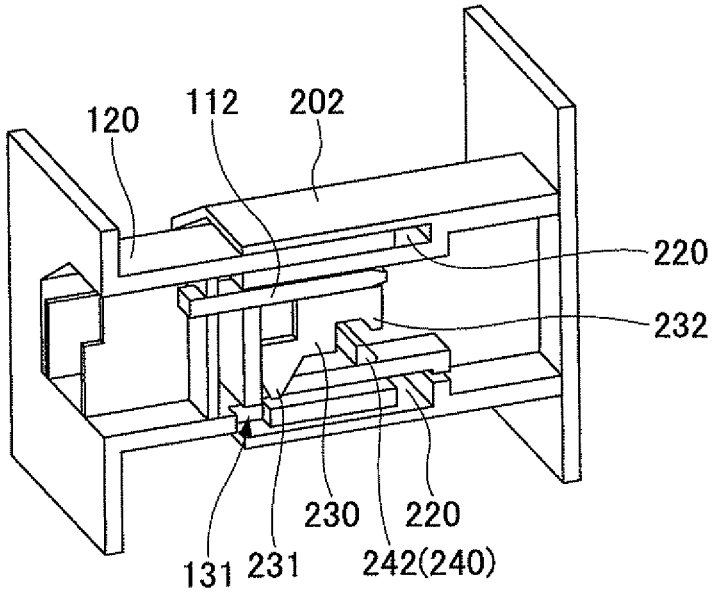
FIG. 14 is another diagram illustrating the connection of the connector according to the embodiment.
Figure 15:
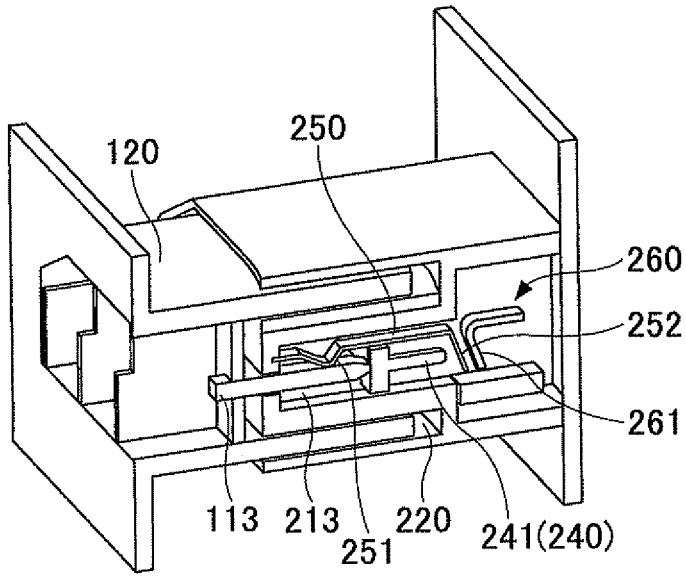
FIG. 15 is another diagram illustrating the connection of the connector according to the embodiment.
Figure 16:
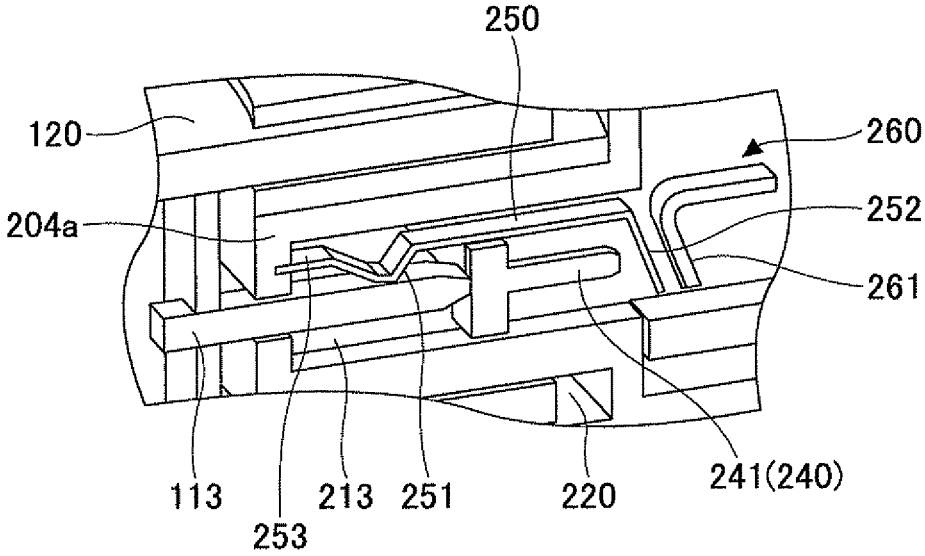
FIG. 16 is an enlarged view of part of the structure illustrated in FIG. 15 according to the embodiment.

Next, as illustrated in FIG. 14 and FIG. 15, the plug connector 100 is inserted further into the jack connector 200. FIG. 14 is a cross-sectional view taken along a plane including a lengthwise cross section of the plug electrode terminal 112 and a lengthwise cross section of the jack terminal opening 212. FIG. 15 is a cross-sectional view taken along a plane including a lengthwise cross section of the plug electrode terminal 113 and a lengthwise cross section of the jack terminal opening 213. As a result, the plug electrode terminals 111 and 113 come into contact with the jack-side terminals 251 of the corresponding movable terminal parts 250, so that the plug electrode terminals 111 and 113 and the corresponding movable terminal parts 250 are electrically connected. Further, as illustrated in FIG. 16, although the plug electrode terminals 111 and 113 are in contact with and pressing the contact pins 241 of the movable contact part 240, the contact pins 241 of the movable contact part 240 are out of contact with the movable terminal parts 250. Therefore, the internal movable terminals 252 of the movable terminal parts 250 and the internal fixed terminals 261 of the fixed terminal parts 260 are out of contact and are not electrically connected. Accordingly, in this state, no electric power is supplied from the plug connector 100 to the jack connector 200.

Figure 17:
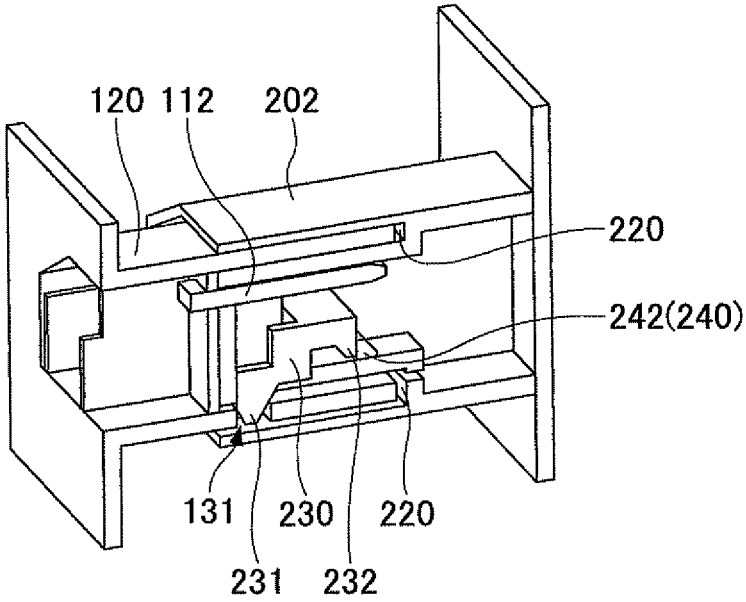
FIG. 17 is another diagram illustrating the connection of the connector according to the embodiment.
Figure 18:
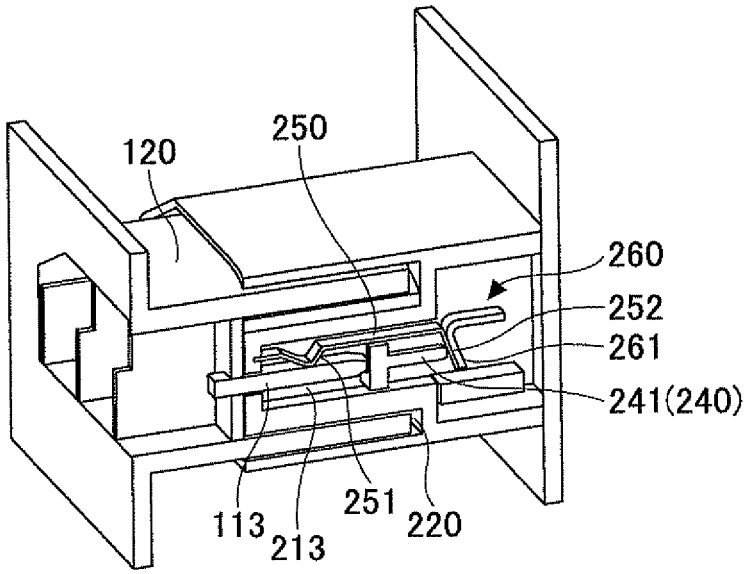
FIG. 18 is another diagram illustrating the connection of the connector according to the embodiment.
Figure 19:
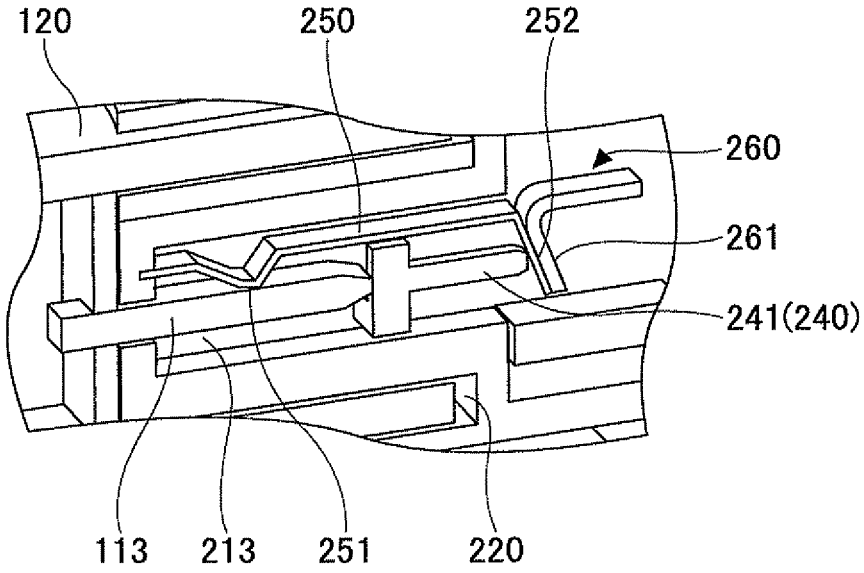
FIG. 19 is an enlarged view of part of the structure illustrated in FIG. 18 according to the embodiment.
Figure 20:
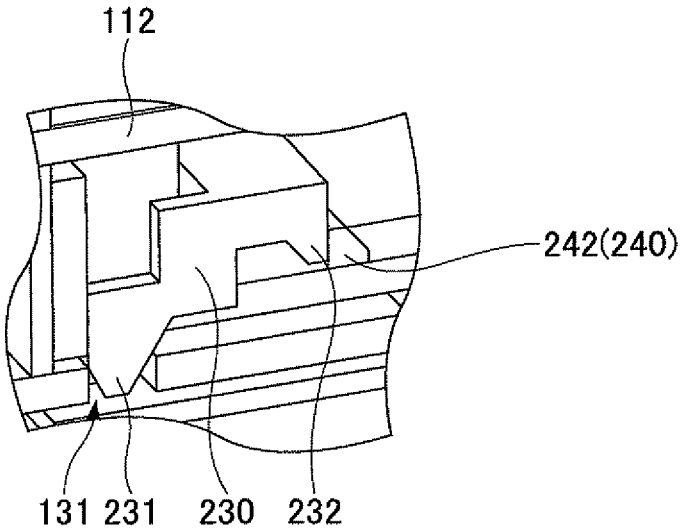
FIG. 20 is an enlarged view of part of the structure illustrated in FIG. 17 according to the embodiment.

Next, as illustrated in FIG. 17 and FIG. 18, the plug connector 100 is inserted further into the jack connector 200. FIG. 17 is a cross-sectional view taken along a plane including a lengthwise cross section of the plug electrode terminal 112 and a lengthwise cross section of the jack terminal opening 212. FIG. 18 is a cross-sectional view taken along a plane including a lengthwise cross section of the plug electrode terminal 113 and a lengthwise cross section of the jack terminal opening 213. As a result, as illustrated in FIG. 19, the plug electrode terminals 111 and 113 press the contact pins 241 of the movable contact part 240, so that the internal movable terminals 252 are pressed by the contact pins 241 to come into contact with and electrically connect to the internal fixed terminals 261. Electric power is thus supplied from the plug connector 100 to the jack connector 200. At this point, as illustrated in FIG. 20, the projecting part 231 of the lock pin 230 enters the frame part opening 131 provided in the housing frame part 120 of the plug connector 100. As a result, the lock pin 230 moves downward, so that the holding part 232 and the connecting part 242 of the movable contact part 240 come into contact with each other. For example, a surface 232*a* (FIG. 8 and FIG. 9B) of the holding part 232, which surface 232*a* faces in a direction away from the projecting part 231, comes into contact with a surface 242*a* (FIG. 8) of the connecting part 242, which surface 242*a* faces in a direction opposite to a direction in which the contact pins 241 extend from the connecting part 242. Consequently, the movable contact part 240 is fixed. The positions of the contact pins 241 of the movable contact part 240 are thus maintained. Therefore, the internal movable terminals 252 and the internal fixed terminals 261 remain in contact, so that the feeding of electric power from the plug connector 100 to the jack connector 200 is maintained.

Next, a description is given of the disconnection (extraction) of the plug connector 100 from the jack connector 200. By pulling out the plug connector 100 from the jack connector 200, the feeding of electric power from the plug connector 100 to the jack connector 200 is stopped.

Figure 21:
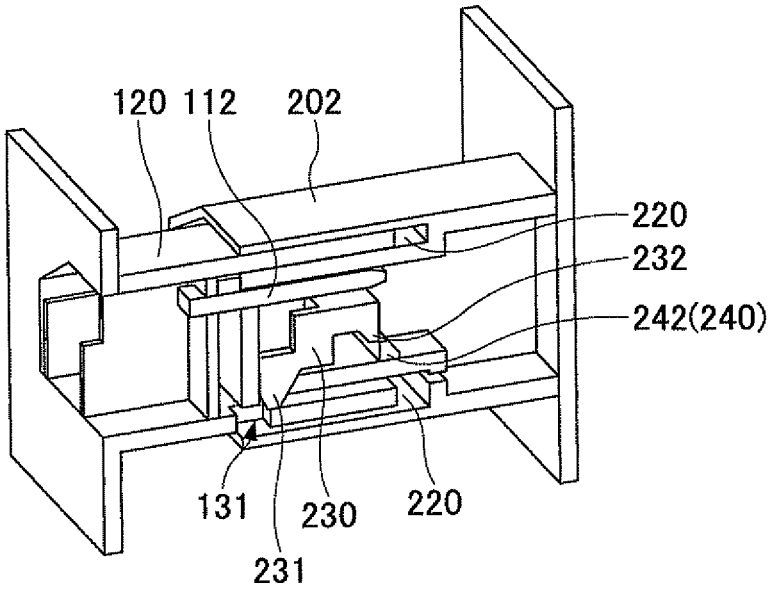
FIG. 21 is a diagram illustrating the extraction of the connector according to the embodiment.
Figure 22:
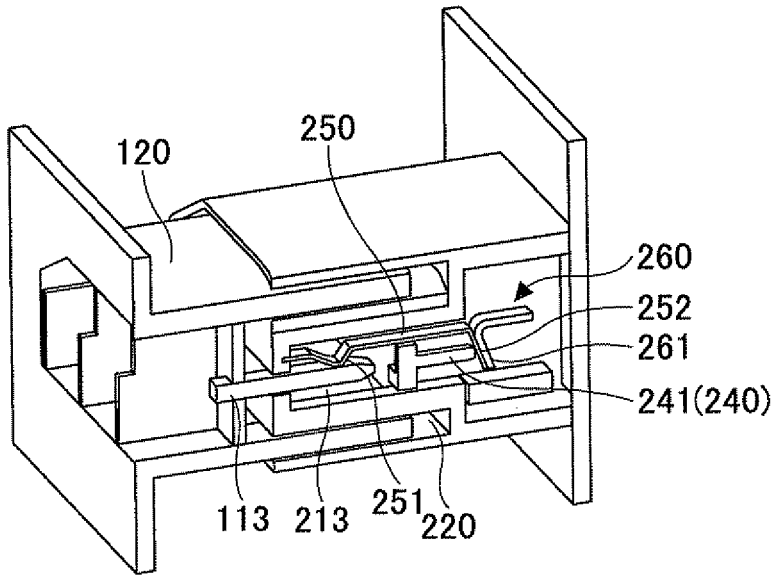
FIG. 22 is another diagram illustrating the extraction of the connector according to the embodiment.
Figure 23:
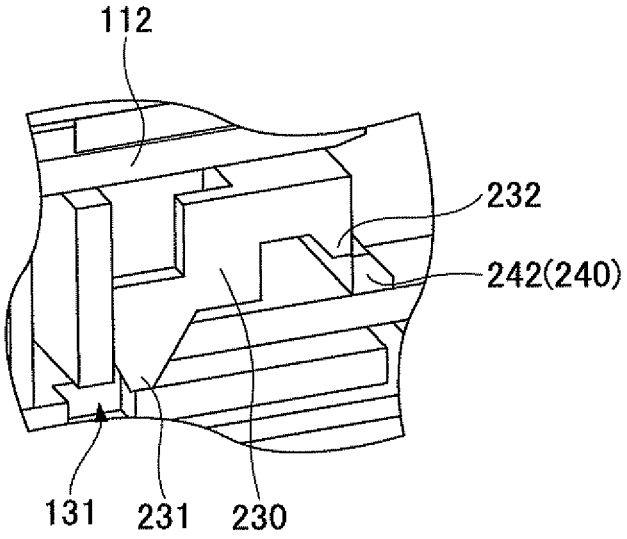
FIG. 23 is an enlarged view of part of the structure illustrated in FIG. 21 according to the embodiment.
Figure 24:
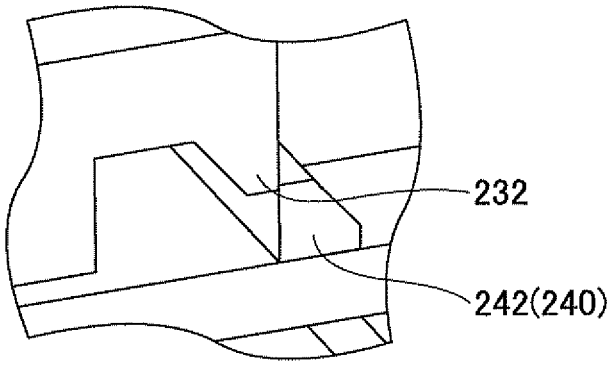
FIG. 24 is another enlarged view of part of the structure illustrated in FIG. 21 according to the embodiment.
Figure 25:
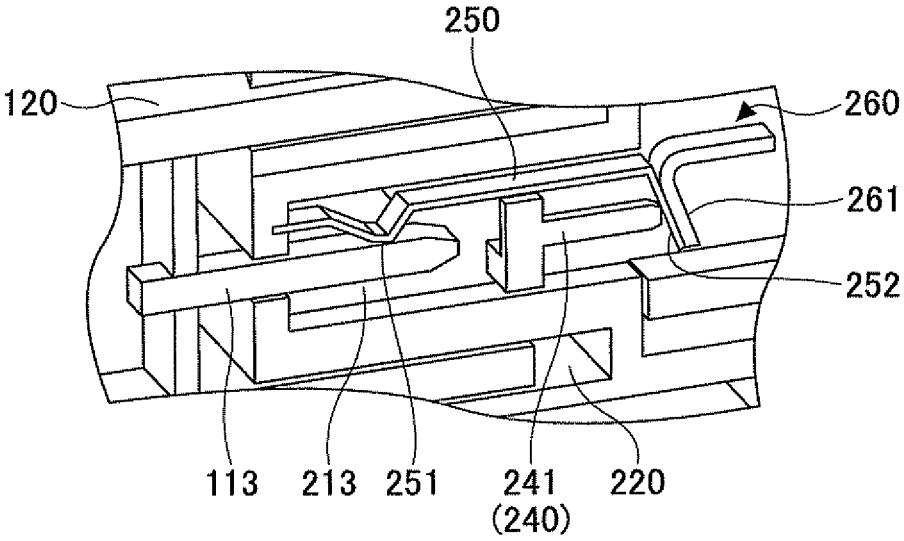
FIG. 25 is an enlarged view of part of the structure illustrated in FIG. 22 according to the embodiment.
Figure 26:
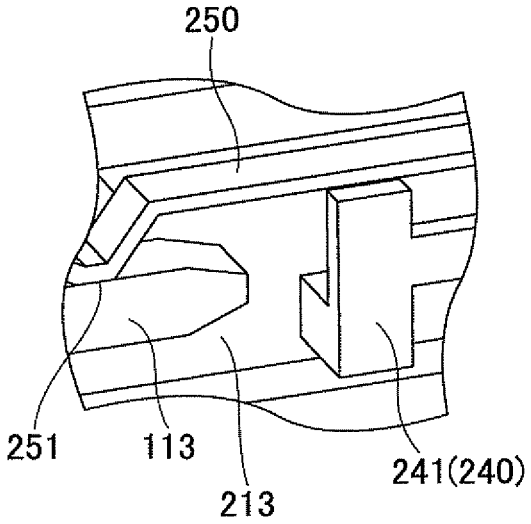
FIG. 26 is another enlarged view of part of the structure illustrated in FIG. 22 according to the embodiment.

As illustrated in FIG. 21 and FIG. 22, at the start of unplugging the plug connector 100 from the jack connector 200, the projecting part 231 of the lock pin 230 starts to come (move) out of the frame part opening 131 provided in the housing frame part 120 of the plug connector 100, so that the lock pin 230 starts to move upward as illustrated in FIG. 23. In this state, as illustrated in FIG. 24, the connecting part 242 of the movable contact part 240 remains held by the holding part 232 of the lock pin 230, so that the positions of the contact pins 242 remain fixed. Accordingly, although the plug electrode terminals 111 and 113 and the contact pins 241 of the movable contact part 240 are separated as illustrated in FIG. 25 and FIG. 26, the positions of the contact pins 241 are maintained by the holding part 232 of the lock pin 230 as illustrated in FIG. 23 and FIG. 24, so that the internal movable terminals 252 of the movable terminal parts 250 are pressed by the contact pins 241 to remain in contact with the internal fixed terminals 261. Therefore, in this state, electric power is supplied from the plug connector 100 to the jack connector 200. FIG. 21 is a cross-sectional view taken along a plane including a lengthwise cross section of the plug electrode terminal 112 and a lengthwise cross section of the jack terminal opening 212. FIG. 22 is a cross-sectional view taken along a plane including a lengthwise cross section of the plug electrode terminal 113 and a lengthwise cross section of the jack terminal opening 213.

Figure 27:
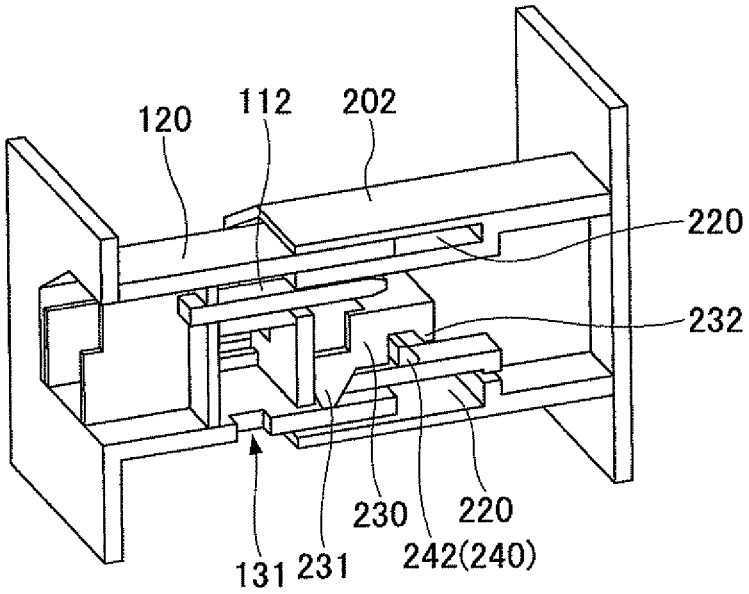
FIG. 27 is another diagram illustrating the extraction of the connector according to the embodiment.
Figure 28:
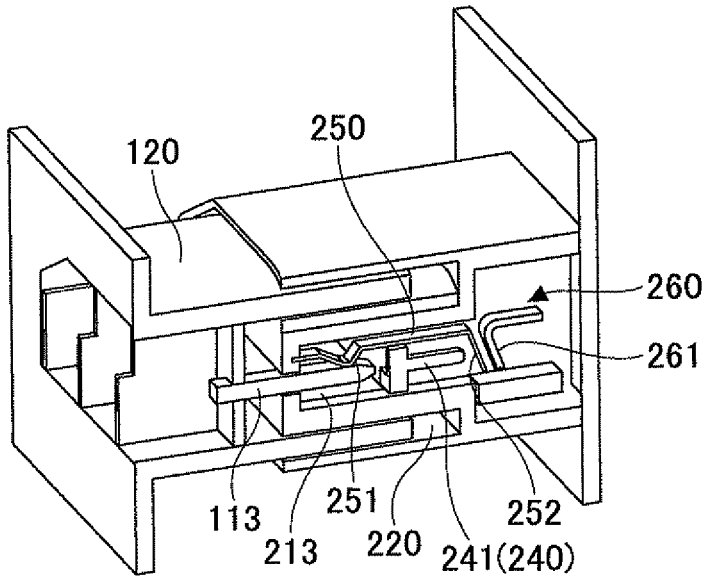
FIG. 28 is another diagram illustrating the extraction of the connector according to the embodiment.
Figure 29:
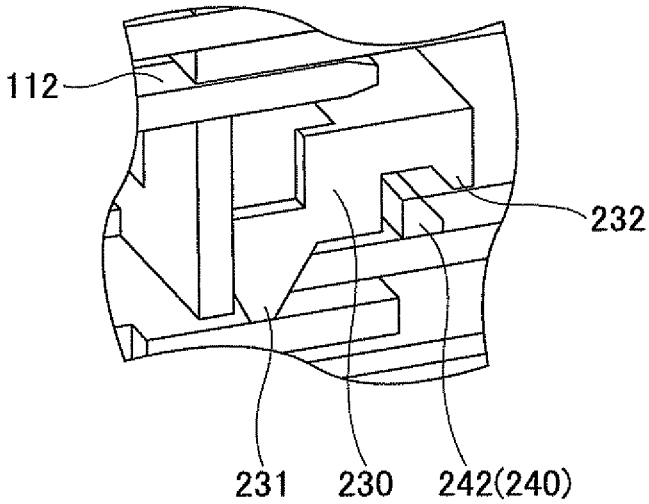
FIG. 29 is an enlarged view of part of the structure illustrated in FIG. 27 according to the embodiment.
Figure 30:
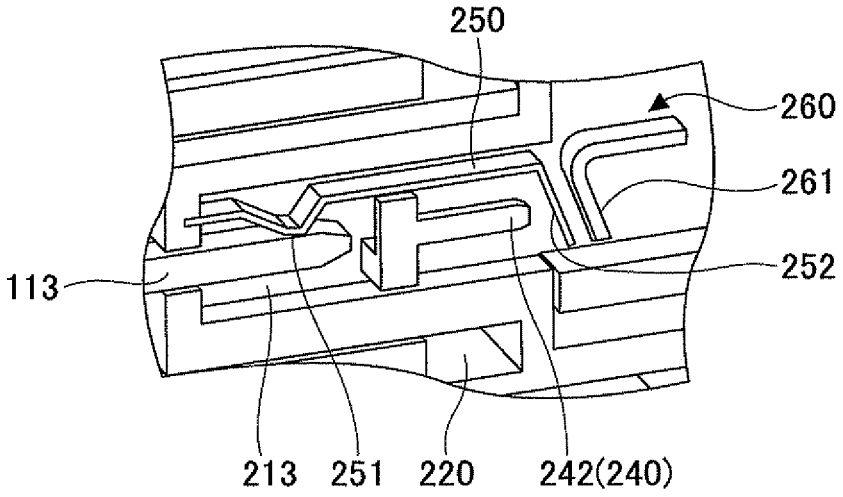
FIG. 30 is an enlarged view of part of the structure illustrated in FIG. 28 according to the embodiment.

Thereafter, as a result of pulling the plug connector 100 further out of the jack connector 200 as illustrated in FIG. 27 and FIG. 28, the projecting part 231 of the lock pin 230 comes completely out of the frame part opening 131 provided in the housing frame part 120 of the plug connector 100, so that the lock pin 230 moves further upward as illustrated in FIG. 29. As a result, the holding part 232 of the lock pin 230, which has held the connecting part 242 of the movable contact part 240, also moves upward, so that the connecting part 242 of the movable contact part 240 and the holding part 232 of the lock pin 230 come out of contact. At this point, as illustrated in FIG. 30, because of the spring characteristic of the internal movable terminals 252 of the movable terminal parts 250, the contact pins 241 are pressed to move toward the plug electrode terminals 111 and 113.

As a result, the internal movable terminals 252 and the internal fixed terminals 261 are out of contact, although the plug electrode terminals 111 and 113 remain in contact with the jack-side terminals 251, so that the feeding of electric power from the plug connector 100 to the jack connector 200 is stopped.

Thereafter, by pulling the plug connector 100 further out of the jack connector 200, the plug electrode terminals 111 and 113 are caused to come out of contact with the jack-side terminals 251, so that the plug connector 100 and the jack connector 200 are completely separated.

According to the connector of this embodiment, the contact for the feeding of electric power is made not between the plug electrode terminals 111 and 113 of the plug connector 100 and the jack-side terminals 251 of the jack connector 200, but between the internal movable terminals 252 of the movable terminal parts 250 and the internal fixed terminals 261 of the fixed terminal parts 260 inside the jack connector 200. That is, the feeding of electric power from the plug connector 100 to the jack connector 200 is started or stopped not in response to the plug electrode terminals 111 and 113 coming into or out of contact with the jack-side terminals 251 but in response to the internal movable terminals 252 coming into or out of contact with the internal fixed terminals 261.

Accordingly, no arc is generated between the plug electrode terminals 111 and 113 of the plug connector 100 and the jack-side terminals 251 of the jack connector 200, so that it is possible to improve the useful service life and the reliability of the connector. Further, the internal movable terminals 252 (in contact with the internal fixed terminals 261) are separated promptly from the internal fixed terminals 261 by the resilience of a strong spring characteristic of the internal movable terminals 252. Therefore, even if an arc is generated during this period of separation, the arc is generated for an extremely short period of time, so as to hardly cause damage to the internal movable terminals 252 or the internal fixed terminals 261.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A connector connectable to another connector, the connector comprising:

a movable contact part that has a one-piece structure and that is formed of an insulating material, wherein the movable contact part includes a plurality of contact pins and a connecting part that connects the contact pins, wherein the contact pins extend from the connecting part in an insertion direction in which said another connector is inserted into the connector;

a plurality of electrically conductive movable terminal parts each electrically connectable to one of a plurality of electrically conductive plug electrode terminals of said another connector; and a plurality of electrically conductive fixed terminal parts each electrically connectable to one of the movable terminal parts, wherein, when the connector is connected to said another connector, the movable contact part is pressed by the plug electrode terminals of said another connector each inserted into one of a plurality of jack terminal opening parts of the connector after the movable terminal parts come into electrical contact with the plug electrode terminals, and the contact pins of the movable contact part come into contact with and press the movable terminal parts toward the fixed terminal parts so as to cause the movable terminal parts to come into electrical contact with the fixed terminal parts.

2. The connector as claimed in claim 1, wherein each of the movable terminal parts includes a terminal portion including a first surface facing toward the corresponding fixed terminal part and a second surface opposite to the first surface, and wherein, when the connector is connected to said another connector, each of the contact pins comes into contact with and presses the second surface of the terminal portion so that the first surface of the terminal portion comes into electrical contact with the fixed terminal part.

3. A connector, comprising:

a first connector including a plurality of electrically conductive plug electrode terminals, and a housing frame part; and a second connector including a movable contact part that has a one-piece structure and that is formed of an insulating material, a plurality of electrically conductive movable terminal parts, and a plurality of electrically conductive fixed terminal parts, wherein the movable contact part includes a plurality of contact pins and a connecting part that connects the contact pins wherein the contact pins extend from the connecting part in a direction in which the first connector is inserted into the second connector, and wherein, when the first connector and the second connector are fit to each other, the movable contact part is pressed by the plug electrode terminals of the first connector each inserted into one of a plurality of jack terminal opening parts of the second connector after the movable terminal parts come into electrical contact with the plug electrode terminals, and the contact pins of the movable contact part come into contact with and press the movable terminal parts toward the fixed terminal parts so as to cause the movable terminal parts to come into electrical contact with the fixed terminal parts.

4. The connector as claimed in claim 3, wherein each of the movable terminal parts includes a terminal portion including a first surface facing toward the corresponding fixed terminal part and a second surface opposite to the first surface, and wherein, when the first connector and the second connector are fit to each other, each of the contact pins comes into contact with and presses the second surface of the terminal portion so that the first surface of the terminal portion comes into electrical contact with the fixed terminal part.

5. A connector, comprising:

a movable contact part formed of an insulating material;

an electrically conductive movable terminal part;

an electrically conductive fixed terminal part;

and a lock pin that includes a flat surface at a leading end in an insertion direction in which another connector is inserted into the connector, the flat surface being perpendicular to the insertion direction, wherein, with said another connector being fit into the connector, the flat surface is in contact with a flat surface of the movable contact part so as to prevent the movable contact part from moving in a direction opposite to the insertion direction.

6. The connector as claimed in claim 5, wherein the lock pin is configured to be pressed by the housing frame part of said another connector inserted into the connecting frame groove part, so as to allow the movable terminal part to move toward the fixed terminal part.

7. The connector as claimed in claim 5, wherein the lock pin further includes a holding part provided at the leading end, the holding part including the flat surface on a first side and an inclined surface on a second side opposite to the first side, wherein, with said another connector not being inserted in the connector, the holding part holds the movable contact part with the inclined surface of the holding part is in contact with an inclined surface of the movable contact part formed on a side opposite to the flat surface of the movable contact part.

8. The connector as claimed in claim 5, further comprising:

a connecting frame groove part into which a housing frame part of said another connector is to be inserted, wherein the lock pin further includes a holding part provided at the leading end and a projecting part provided at a trailing end that is opposite to the leading end, the holding part including the flat surface of the lock pin and the projecting part projecting in the connecting frame groove part, and wherein, with said another connector being fit into the connector, the projecting part is in a frame part opening provided in the housing frame part of said another connector.

9. The connector as claimed in claim 8, wherein, at a time of disconnecting the connector from said another connector, the projecting part moves out of the frame part opening of the other connector to cause the holding part and the movable contact part to come out of contact to allow the movable contact part to move, so that the movable terminal part and the fixed terminal part are separated to be electrically disconnected.

10. The connector as claimed in claim 8, wherein the movable terminal part has a spring characteristic to exert a force toward the movable contact part with the movable terminal part and the fixed terminal part being in contact.

11. A connector, comprising:

a first connector including an electrically conductive plug electrode terminal, and a housing frame part; and a second connector including:

a movable contact part formed of an insulating material, an electrically conductive movable terminal part, an electrically conductive fixed terminal part, and a lock pin that includes a flat surface at a leading end in an insertion direction in which the first connector is inserted into the second connector, the flat surface being perpendicular to the insertion direction, wherein, with the first connector being fit into the second connector, the flat surface is in contact with a flat surface of the movable contact part so as to prevent the movable contact part from moving in a direction opposite to the insertion direction.

12. The connector as claimed in claim 11, wherein the lock pin is configured to be pressed by the housing frame part of the first connector inserted into the connecting frame groove part of the second connector, so as to allow the movable terminal part to move toward the fixed terminal part.

13. The connector as claimed in claim 11, wherein the lock pin further includes a holding part provided at the leading end, the holding part including the flat surface on a first side and an inclined surface on a second side opposite to the first side, wherein, with the first connector not being inserted in the second connector, the holding part holds the movable contact part with the inclined surface of the holding part is in contact with an inclined surface of the movable contact part formed on a side opposite to the flat surface of the movable contact part.

14. The connector as claimed in claim 11, wherein the second connector further includes a connecting frame groove part into which a housing frame part of the first connector is inserted, wherein the lock pin further includes a holding part provided at the leading end and a projecting part provided at a trailing end that is opposite to the leading end, the holding part including the flat surface of the lock pin and the projecting part projecting in the connecting frame groove part, and wherein, with the first connector being fit into the second connector, the projecting part is in a frame part opening provided in the housing frame part of the first connector.

15. The connector as claimed in claim 14, wherein, at a time of disconnecting the first connector and the second connector, the projecting part of the second connector moves out of the frame part opening of the first connector to cause the holding part and the movable contact part to come out of contact to allow the movable contact part to move, so that the movable terminal part and the fixed terminal part are separated to be electrically disconnected.

16. The connector as claimed in claim 14, wherein the movable terminal part of the second connector has a spring characteristic to exert a force toward the movable contact part with the movable terminal part and the fixed terminal part being in contact.

* * * * *